US006276696B1

(12) United States Patent
Wong

(10) Patent No.: US 6,276,696 B1
(45) Date of Patent: Aug. 21, 2001

(54) IN-LINE ROLLER SKATES

(76) Inventor: Jon Garfield Wong, 252 Ximeno Ave., Long Beach, CA (US) 90803

( * ) Notice: Subject to any disclaimer, the term of this patent is extended or adjusted under 35 U.S.C. 154(b) by 498 days.

(21) Appl. No.: 08/678,991

(22) Filed: Jul. 12, 1996

(51) Int. Cl.[7] ..... A63C 17/06
(52) U.S. Cl. ..... 280/11.222; 280/11.223
(58) Field of Search ..... 280/11.19, 11.22, 280/11.23, 11.27; 301/5.3, 5.7

(56) References Cited

U.S. PATENT DOCUMENTS

| | | | | |
|---|---|---|---|---|
| 97,075 | * | 11/1869 | Gibson | 280/7.13 |
| 1,260,692 | * | 3/1918 | Madsen | 280/11.22 |
| 2,145,219 | * | 1/1939 | Burton | 280/11.22 |
| 2,570,349 | | 10/1951 | Kardhordo . | |
| 3,287,023 | * | 11/1966 | Ware | 301/5.7 |
| 3,877,710 | * | 4/1975 | Nyitrai | 280/11.23 |
| 3,880,441 | | 4/1975 | Silver . | |
| 5,028,058 | | 7/1991 | Olson . | |
| 5,046,746 | | 9/1991 | Gierveld . | |
| 5,048,848 | | 9/1991 | Olson et al. . | |
| 5,068,956 | | 12/1991 | Malewicz . | |
| 5,092,614 | | 3/1992 | Malewicz . | |
| 5,253,884 | | 10/1993 | Landers . | |
| 5,366,232 | | 11/1994 | Pozzobon et al. . | |
| 5,374,072 | | 12/1994 | Landers . | |
| 5,388,846 | | 2/1995 | Gierveld . | |
| 5,413,362 | * | 5/1995 | De Santis | 280/11.2 |
| 5,452,907 | | 9/1995 | Meibock et al. . | |
| 5,462,297 | | 10/1995 | Lee . | |
| 5,480,168 | | 1/1996 | Chen . | |
| 5,486,011 | | 1/1996 | Nelson . | |
| 5,505,470 | | 4/1996 | Hoshizaki . | |
| 5,513,861 | * | 5/1996 | Monroy et al. | 280/11.22 |
| 5,513,862 | | 5/1996 | Chuang . | |
| 5,536,025 | * | 7/1996 | Landay | 280/11.22 |
| 5,704,620 | * | 1/1998 | Oliemans et al. | 280/11.27 |

FOREIGN PATENT DOCUMENTS

| | | | | |
|---|---|---|---|---|
| 742829 | * | 3/1933 | (FR) | 301/5.7 |
| 377375 | * | 7/1932 | (GB) | 280/11.22 |
| 2219514 | * | 12/1989 | (GB) | 280/11.22 |

* cited by examiner

*Primary Examiner*—J. J. Swann
*Assistant Examiner*—David R. Dunn
(74) *Attorney, Agent, or Firm*—Raymond Sun

(57) ABSTRACT

A roller skate includes a chassis having a first frame and a second frame extending longitudinally parallel to each other, first through fourth wheels rotatably mounted in spaced apart manner between the first and second frames, and first through fourth slots provided in spaced apart manner in each frame. The first slot is positioned adjacent a front end of the frame and the fourth slot is positioned adjacent a rear end of the frame. The first through fourth wheels are mounted adjacent the first through fourth slots, respectively, of both frames. The center of the fourth slot is positioned at a vertical level higher than the center of the first slot.

16 Claims, 10 Drawing Sheets

IN-LINE ROLLER SKATES

BACKGROUND OF THE INVENTION

1. Field of the Invention

The present invention relates to in-line roller skates, and in particular, to in-line roller skates having wheels with different sizes to optimize the speed and maneuverability of the skates. The in-line roller skates of the present invention are also provided with rockering inserts which are configured to provide improved rockerability and flexibility in performance.

2. Description of the Prior Art

In-line roller skates have become increasingly popular both for sporting use and for recreational use. Regardless of the use, speed and maneuverability are the two most important considerations to all skaters.

Some skaters will prefer in-line skates that provide excellent maneuverability. Such skaters include recreational skaters, hockey players, or less-experienced skaters who prefer control and maneuverability over speed.

On the other hand, other skaters will prefer in-line skates that provide the potential to achieve greater speeds. Examples include those who participate in racing where most racing tracks tend to be straighter and whose turns are less pronounced, thereby requiring less maneuverability.

The in-line roller skates that are currently available are typically provided with four wheels mounted in spaced-apart and. equi-distant manner between a pair of frames that make up the chassis for supporting the skating shoe. All four wheels have the same diameter. The most popular diameters in today's market range from 72 mm to 76 mm, with 72 mm being the most popular. Skaters who desire more speed and less maneuverability will prefer wheels with larger diameters because they provide wider rotational surfaces per revolution which increase high end speed. Skaters who desire less speed and more maneuverability will prefer wheels with smaller diameters because a smaller wheel is easier to maneuver. In addition, smaller wheels tend to bring the chassis lower to the ground, thereby lowering the center of gravity and providing the skater with better control and maneuverability.

The drawback with the currently-available in-line roller skates is that they do not provide the capability to achieve both high speed and excellent maneuverability. For example, skaters who use four 72 mm wheels will have relatively good maneuverability, but will have difficulty maintaining high speeds. Conversely, skaters who use four 76 mm wheels will be able to achieve relatively high speeds, but may not have good maneuverability. Consequently, many skaters choose to compromise both speed and maneuverability by selecting four wheels that provide some degree of maneuverability with some potential for speed, but with less than optimal performance for both.

In addition, it is not possible to achieve very high speeds with such currently-available in-line roller skates. For example, if a skater were to select four wheels with a diameter of 78 mm or greater, the skater would be so high off the ground that it would be very difficult to maneuver the skates.

Many currently-available in-line roller skates also provide "rockerability", in which the type of contact between the ground and the wheels is adjusted. For example, the front and rear wheels can be adjusted to a position slightly higher than the two intermediate wheels, so that the skater can obtain a "rockering effect". Positioning the front and rear wheels at a higher vertical level than the intermediate wheels also shortens the wheel base, which is defined as the distance between the axles of the front-most and rear-most wheels along the frames. Shortening the wheel base allows the skater to make faster turns and experience quicker maneuverability because the skater is in effect riding on the two intermediate wheels. Thus, the currently-available in-line roller skates also allow the skater to adjust the type of ground contact of the skates to suit his or her skating style, experience and intended use.

Thus, there remains a need for in-line roller skates that are easy to maneuver yet are capable of achieving high speeds without compromising either attribute. There also remains a need for in-line roller skates that provide improved rockerability, where the skater has more flexibility in adjusting the type and degree of ground contact.

SUMMARY OF THE DISCLOSURE

In order to accomplish the objects of the present invention, there is provided a roller skate including a chassis having a first frame and a second frame extending longitudinally parallel to each other, first through fourth wheels rotatably mounted in spaced apart manner between the first and second frames, and first through fourth slots provided in spaced apart manner in each frame. The first slot is positioned adjacent a front end of the frame and the fourth slot is positioned adjacent a rear end of the frame. The first through fourth wheels are mounted adjacent the first through fourth slots, respectively, of both frames. The center of the fourth slot is positioned at a vertical level higher than the center of the first slot.

In one embodiment of the present invention, the centers of the third and fourth slots are positioned on a horizontal line which is at a vertical level higher than a horizontal line on which the centers of the first and second slots are positioned. In another embodiment of the present invention, the centers of all the slots are positioned at different vertical levels, with the center of the fourth slot positioned at a vertical level that is higher than the vertical level of the centers of the first, second and third slots.

In another embodiment of the present invention, the third and fourth wheels are larger than the first and second wheels, the first and second wheels have the same size, and the third and fourth wheels have the same size. The first and fourth slots are angled with respect to the horizontal and vertical axes. In another embodiment, the first wheel is larger than the second wheel.

In yet another embodiment of the present invention, a fifth slot is positioned between the fourth slot and the rear end of each frame, and a fifth wheel is mounted adjacent the fifth slot, with the centers of the third, fourth and fifth slots positioned along the same horizontal line.

In yet a further embodiment of the present invention, the roller skate has only three wheels and three slots provided in spaced apart manner on each frame, with the centers of the second and third slots positioned on a horizontal line which is at a vertical level higher than the center of the first slot.

The roller skate according to the present invention further includes a plurality of webs mounted between the first and second frames for providing cross-support to the chassis. The webs are mounted adjacent upper edges of the first and second frames at an angle with respect to a horizontal axis (i.e., parallel to the ground) to provide increased clearance for the wheels. The webs are progressively larger from the front to the rear of the frames to distribute more load at the rear of the chassis.

The roller skates according to the present invention are further provided with a first insert fitted inside the first and fourth slots. The first insert has a first corner and at least one other corner, the insert further including a bore having a Figure-8 configuration defining two substantially circular openings. The bore is positioned adjacent the first corner and closer to the first corner than other corners.

In some embodiments, a spacer collar is positioned between the first insert and the first or fourth wheel. The spacer collar has a substantially circular bore for alignment with a first of the two substantially circular openings of the first insert for passage of a wheel axle therethrough. The spacer collar further includes a substantially circular protrusion which is adapted to be fitted inside the second of the substantially circular openings of the first insert to prevent the wheel axle from slipping into the second substantially circular opening of the first insert.

The roller skates according to the present invention are further provided with a second insert fitted inside the second and third slots. The second insert has an upper end, a lower end and a bore. The bore has a substantially circular configuration and is positioned closer to either the upper or the lower end than to the other end.

The present invention also provides a method of adjusting the wheel base and the height of the chassis of the roller skate. The first step of this method provides the in-line roller skate of the present invention. In the second step, the first insert is positioned in the first slot such that the bore of the first insert is closer to the first corner of the first slot than a second corner of the first slot opposite the first corner, and the fourth insert is positioned in the fourth slot such that the bore of the fourth insert is closer to a second corner of the fourth slot than the first corner of the fourth slot opposite the second corner. In the third step, the first insert is rotated in the first slot by 180 degrees so that the bore of the first insert is closer to the second corner of the first slot than the first corner of the first slot, and the fourth insert is rotated in the fourth slot by 180 degrees so that the bore of the fourth insert is closer to the first corner of the fourth slot than the second corner of the fourth slot. In the fourth step, the second insert is positioned in the second slot such that the bore of the second insert is closer to either the upper or lower end of the second slot than the other end of the second slot, and the third insert is positioned in the third slot such that the bore of the third insert is closer to either the upper or lower end of the third slot than the other end of the third slot. In the fifth step, the second insert is rotated in the second slot by 180 degrees so that the bore of the second insert is closer to the other end of the second slot, and the third insert is rotated in the third slot by 180 degrees so that the bore of the third insert is closer to the other end of the third slot.

Thus, the in-line roller skates according to the present invention provide both improved maneuverability and the potential for achieving greater speeds by providing smaller front wheels to enhance maneuverability and larger rear wheels to achieve higher speed. The present invention further provides two sets of inserts that allow the skater to simultaneously adjust the wheel base of the roller skate, and the height of the chassis with respect to the ground. As a result, the skater is able to adjust the roller skates to suit his or her skating style, experience and intended use.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

Figure 1:
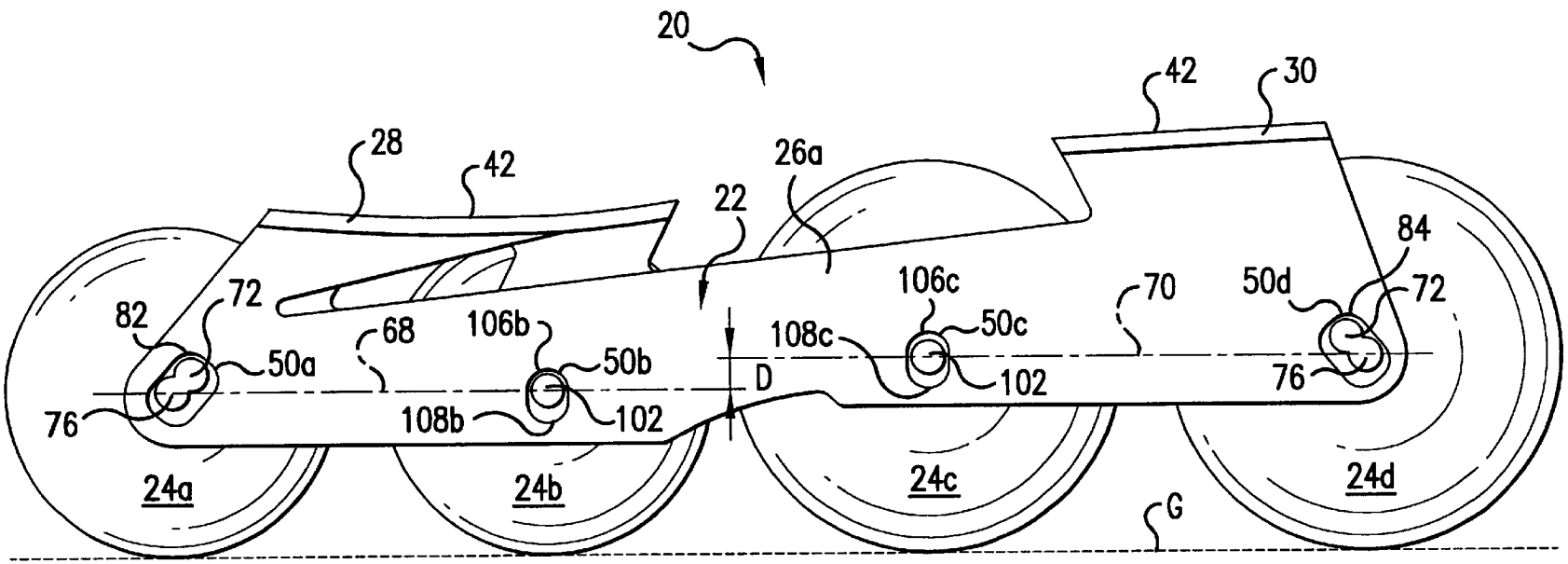
FIG. 1 is a side elevational view of the chassis and wheels of an in-line roller skate according to a first embodiment of the present invention with the inserts provided in a non-rockering position.
Figure 2:
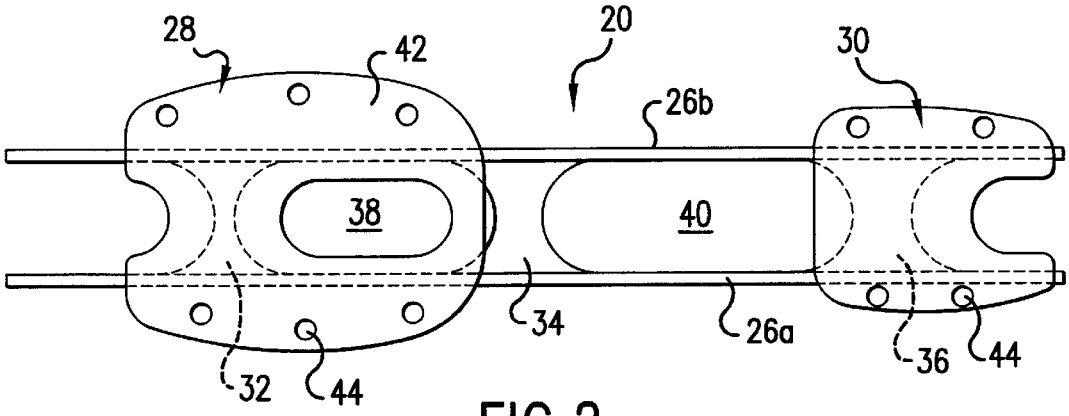
FIG. 2 is a top plan view of the chassis of the in-line roller skate of FIG. 1.

Referring to FIGS. 1 and 2, the in-line roller skate 20 according to the present invention includes a chassis 22 to which a plurality of wheels 24*a*, 24*b*, 24*c* and 24*d* are rotatably mounted. The chassis 22 includes two frames 26*a*, 26*b* extending longitudinally parallel to each other, and a front mounting bracket 28 and a rear mounting bracket 30 connected to the top of the frames 26*a*, 26*b* and connecting the frames 26*a*, 26*b*. Three transversely oriented webs 32, 34 and 36 (see also FIG. 4) connect the inner walls of the frames 26*a*, 26*b* along the length of the frames 26*a*, 26*b* to provide cross-support for the frames 26*a*, 26*b*. The webs 32, 34 and 36 define two intermediate spaces 38 and 40 for receiving intermediate wheels 24*b* and 24*c*, with the front wheel 24*a* positioned in front of web 32, and the rear wheel 24*d* positioned behind web 36.

The chassis 22 may be formed by injection molding, die extrusion, casting, welding, stamping or other conventional means using a plastic or metal material. The mounting brackets 28, 30 and webs 32, 34, 36 may be provided integrally with the frames 26*a*, 26*b*, or they may be provided separately and then attached or connected to provide the chassis 22.

A boot or skating shoe (not shown) is secured to the top surface 42 of the mounting brackets 28 and 30 by any conventional means. As a non-limiting example, rivets or bolts may be inserted through the openings 44 in the mounting brackets 28 and 30 and secured to the sole of the boot. In addition or optionally, the boot may be clamped or latched to the chassis 22.

Figure 3A:
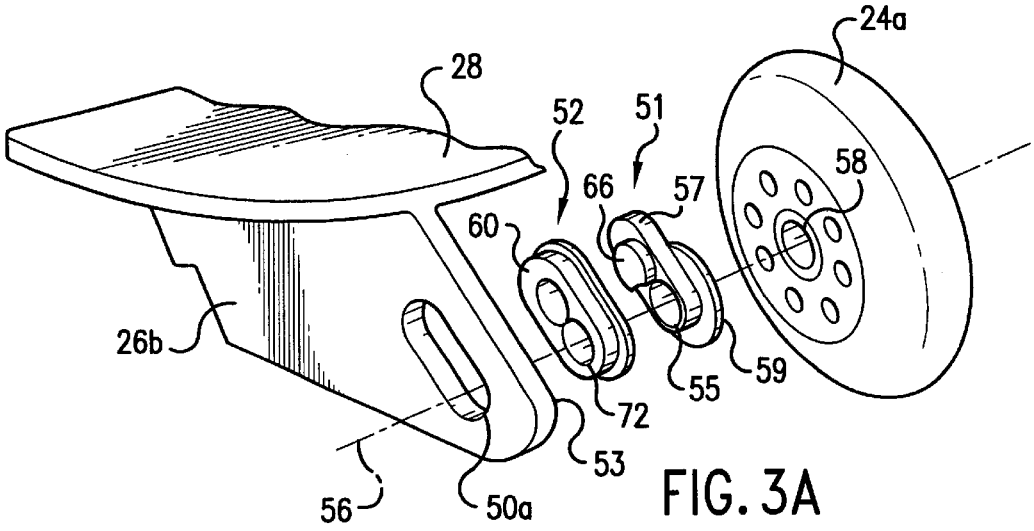
FIG. 3A is an exploded perspective view of a section of the chassis and a wheel illustrating an exemplary wheel mounting assembly for the in-line roller skate of FIG. 1.

Each wheel 24 is positioned between the frames 26*a*, 26*b*, with the axle of the wheel 24 positioned at aligned axle slots 50*a*, 50*b*, 50*c* or 50*d*. In this regard, the slot 50*a* in frame 26*a* is preferably aligned along a rotational axis (such as the axis denoted by the numeral 56 in FIG. 3A) with slot 50*a* in frame 26*b*, and the other slots 50*b*, 50*c* and 50*d* of the frames 26*a*, 26*b* are preferably aligned in the same manner. Referring to FIG. 3A, an insert 52 is adapted to be fitted inside slot 50*a* from the inside surface 53 of the frame 26*b*. A spacer collar 51 separates the wheel 24*a* from the insert 52. The axle (not shown) of wheel 24*a* extends along the rotational axis 56, and specifically extends through the axle bore 58 of the wheel 24*a*, a bore 55 in the spacer collar 51 and a bore 72 in the insert 52 to be rotatably mounted at the slot 50*a*. A similar insert 52 and spacer collar 51 can be positioned on the other side of wheel 24*a* for mounting to the frame 26*a*. As shown in FIG. 3A, each wheel 24*a* has a traction surface that is rounded to improve maneuverability.

Figure 5A:
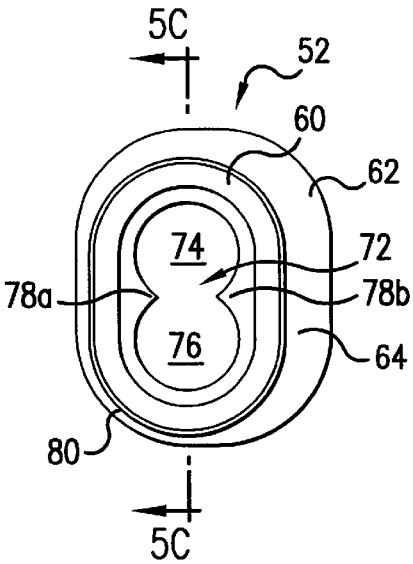
FIG. 5A is a rear view of an insert positioned inside a slot of the chassis of FIG. 1.
Figure 5B:
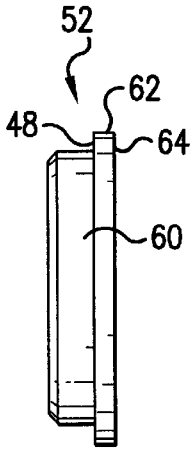
FIG. 5B is a side view of the insert of FIG. 5A.
Figure 5C:
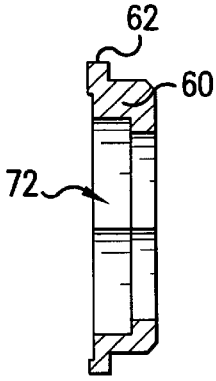
FIG. 5C is a cross-sectional side view of the insert of FIG. 5A taken along lines 5C—5C thereof.

Referring also to FIGS. 5A–5C, the insert 52 has a substantially oval-shaped body 60 surrounded by a flange 62. FIG. 5A is a rear view of the insert 52 facing the inner surface 53 of frame 26*b*. The body portion 60 is preferably configured with the same configuration of the slots 50*a* and 50*d* and adapted to be fitted therein. The rear surface 48 of the flange 62 may be rested against the inside surface 53 of the frame 26*b*, or a stepped surface (not shown) may be provided on the inside surface 53 surrounding the slot 50*a* for receiving the flange 60 so that the front surface 64 of the insert 52 is flush with the inside surface 53 of frame 26*b*. In addition, the body 60 of the insert 52 defines a bore 72 that is shaped substantially as a Figure-8. Specifically, the bore 72 has an upper substantially circular opening 74 and a lower substantially circular opening 76 that are interrupted in part by opposing sharp projections 78*a* and 78*b* extending into the bore 72. Each opening 74 and 76 is adapted to receive the axle of a wheel.

Figure 6A:
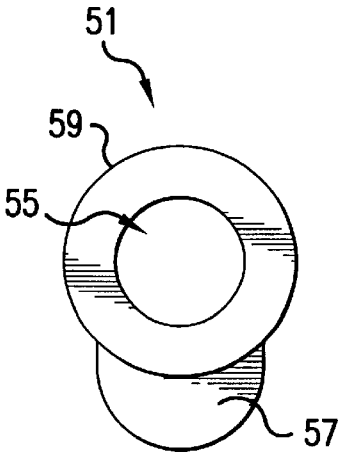
FIG. 6A is a front view of a spacer collar adapted for use with the insert of FIG. 5A.
Figure 6B:
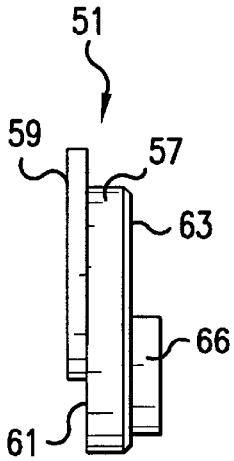
FIG. 6B is a side view of the spacer collar of FIG. 6A.
Figure 6C:
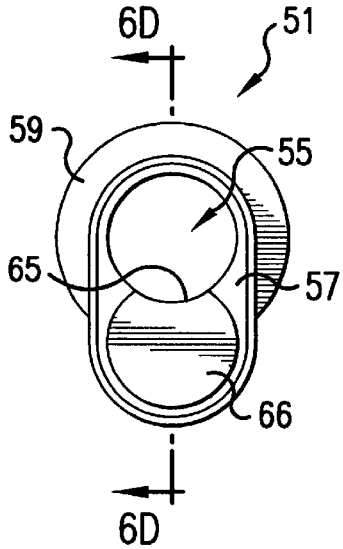
FIG. 6C is a rear view of the spacer collar of FIG. 6A.
Figure 6D:
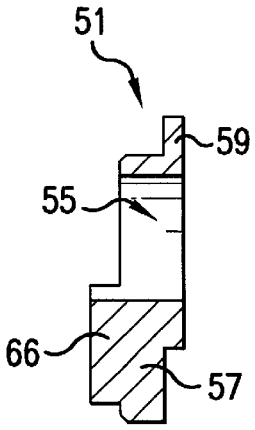
FIG. 6D is a cross-sectional side view of the spacer collar of FIG. 6C taken along lines 6D—6D thereof.

Referring now to FIGS. 6A–6D, the spacer collar 51 has a substantially oval-shaped body 57 with a bore 55 provided at either an upper or lower portion. FIG. 6A is a front view of the spacer collar 51 facing the wheel 24*a*. A circular flange 59 or washer portion is attached or otherwise provided about the bore 55 on a front surface 61 of the body 57 for positioning adjacent the bore 58 of the wheel 24*a*. A substantially circular protrusion or stump 66 extends axially from a rear surface 63 of the body 57, and is configured to be fitted inside one of the two substantially circular openings 74 or 76 of the insert 52. The protrusion 66 has a curved edge 65 which partially defines the circular configuration of the bore 55 through which the wheel axle extends. The protrusion 66 is fitted inside the circular opening 74 or 76 of the insert 52 that is not being used to hold the wheel axle. For example, if the wheel axle is intended to extend through circular opening 74, then protrusion 66 is fitted inside circular opening 76 to align the bore 55 with the circular opening 74 of bore 72, and to prevent the wheel axle from slipping from circular opening 74 into circular opening 76 during use. When fully mounted, the rear surface 63 of the spacer collar 51 may be rested against the front surface 64 of the insert 52.

Figure 3B:
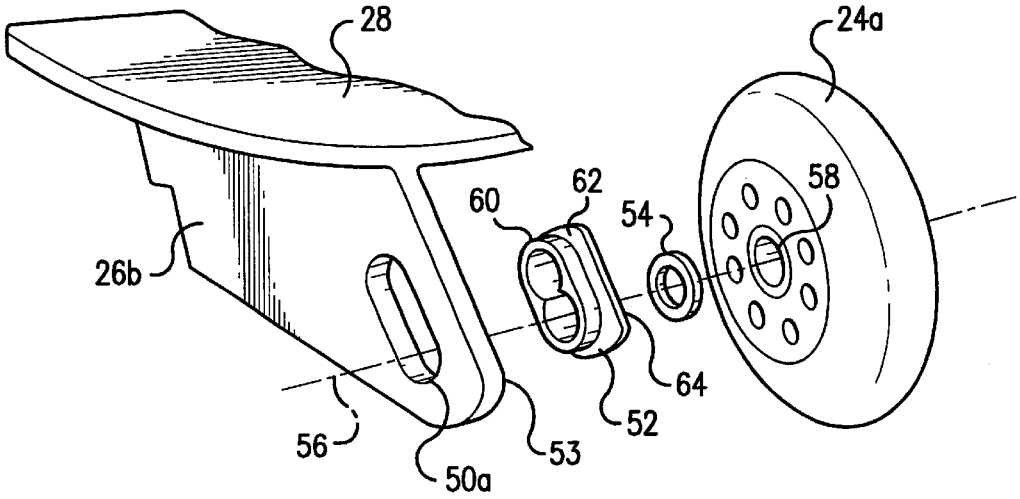
FIG. 3B is an exploded perspective view of a section of the chassis and a wheel illustrating another exemplary wheel mounting assembly for the in-line roller skate of FIG. 1.

FIG. 3B illustrates another mounting structure for the wheel 24*a*. The mounting structure in FIG. 3B is the same as in FIG. 3A, except that instead of the spacer collar 51, a washer 54 now separates the wheel 24*a* from the insert 52. The axle (not shown) of wheel 24*a* extends along the rotational axis 56, and specifically extends through the axle bore 58 of the wheel 24*a*, the opening in the washer 54 and one of the openings 74 or 76 in the insert 52 to be rotatably mounted at the slot 50*a*.

Although two basic mounting structures for the wheel 24*a* have been described, those skilled in the art will appreciate that the mounting structures and related principles can be applied to the other three wheels 24*b*, 24*c*, 24*d* and three slots 50*b*, 50*c*, 50*d*. In addition, additional structure can be provided to improve rotation of the wheels or to achieve other benefits without departing from the spirit and scope of the present invention.

In the first preferred embodiment of the present invention, the in-line roller skate 20 has four wheels 24, with the front wheel 24*a* and the intermediate wheel 24*b* adjacent to it having the same diameter, and the rear wheel 24*d* and the intermediate wheel 24*c* adjacent to it having the same diameter. The diameter of the two front wheels 24*a*, 24*b* are smaller than the diameter of the two rear wheels 24*c*, 24*d*. By providing the front two wheels 24*a*, 24*b* with different diameters than the rear two wheels 24*c*, 24*d*, optimal maneuverability and high speeds can be achieved. The front wheels 24*a*, 24*b* are smaller so the skater can use them to maneuver and make turns. Conversely, the rear wheels 24*c*, 24*d* are larger so that the skater can ride the rear wheels 24*c*, 24*d* to achieve higher speeds. Thus, both maneuverability and high speeds can be achieved with the same in-line roller skate without compromising one attribute for the other.

As non-limiting examples, the two front wheels 24*a* and 24*b* can be provided with a diameter of 66 mm and the two rear wheels 24*c* and 24*d* can be provided with a diameter of 78 mm. Alternatively, the two front wheels 24*a* and 24*b* can be provided with a diameter of 70 mm and the two rear wheels 24*c* and 24*d* can be provided with a diameter of 82 mm. Other sizes can be selected by the skater to suit the skater's specific needs and style.

Referring to FIG. 1, the axle slots 50*a*, 50*b*, 50*c* and 50*d* are substantially oval-shaped. Front and rear axle slots 50*a* and 50*d*, respectively, are angled with respect to the horizontal axis (i.e., parallel to the ground G), while intermediate axle slots 50*b* and 50*c* are substantially vertically oriented with its substantially straight side edges oriented along a vertical axis. In addition, the centers of the front slot 50*a* and the intermediate slot 50*b* adjacent to it are positioned along an imaginary horizontal line 68, parallel to the ground G, that is offset from the imaginary horizontal line 70 which connects the centers of the rear slot 50*d* and the intermediate slot 50*c* adjacent to it. Thus, the two rear slots 50*c* and 50*d* are offset from the two front slots 50*a* and 50*b* by a distance D. Offsetting the two rear slots 50*c* and 50*d* from the two front slots 50*a* and 50*b* allows the chassis 22 to be positioned as close to the ground G as possible, thereby improving maneuverability. This offset of the slots therefore allows the chassis 22 to accomodate two rear wheels 24*c* and 24*d* that are larger than the two front wheels 24*a* and 24*b* while keeping the chassis 22 low to the ground, so that the maneuverability of the in-line roller skate 20 is not compromised.

Figure 4:
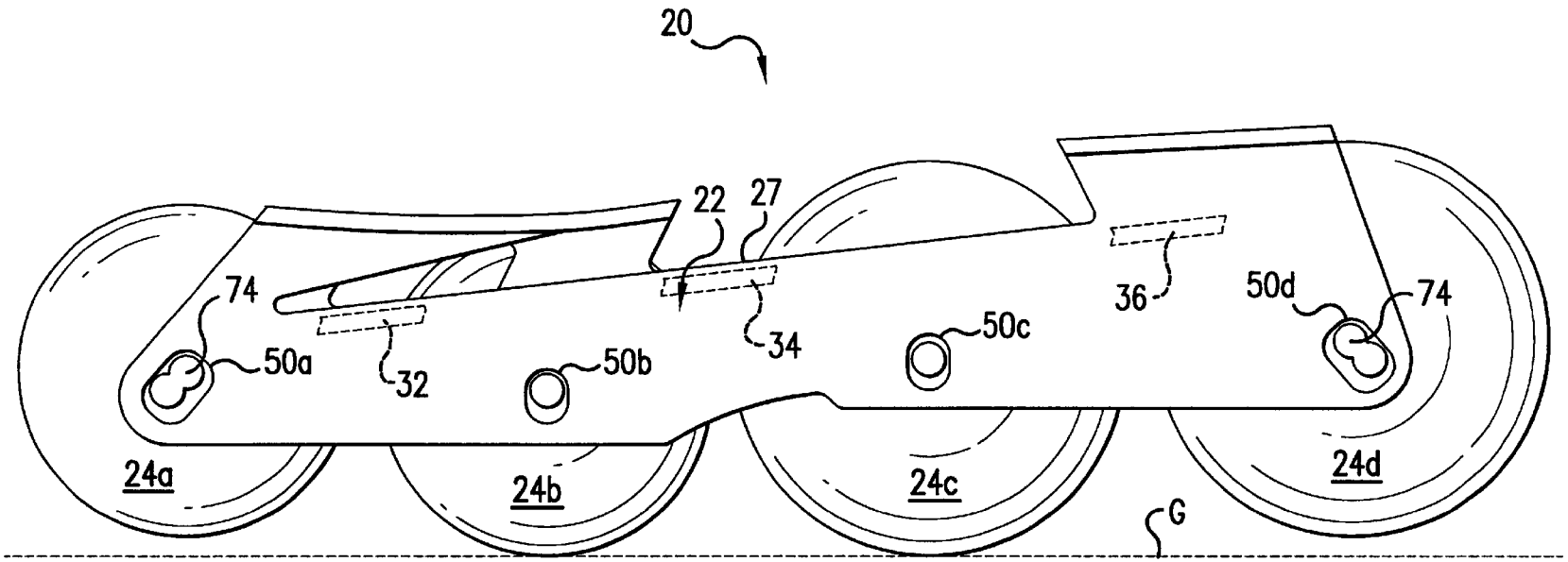
FIG. 4 is a side elevational view of the chassis and wheels of the in-line roller skate of FIG. 1 with the inserts in a rockering position.

FIG. 1 illustrates the front and rear wheels 24*a* and 24*d* of the in-line roller skate 20 in a non-rockering position. In such a position, both front and rear wheels 24*a* and 24*d* would contact the ground G during use. FIG. 4 illustrates the front and rear wheels 24*a* and 24*d* of the in-line roller skate 20 in a rockering position. In such a position, both front and rear wheels 24*a* and 24*d* would be raised off the ground G during use, so that the skate 20 would effectively be riding on the two intermediate wheels 24*b* and 24*c* only.

To allow the skater to adjust the rockerability of the inline roller skate 20, the present invention provides an insert 52 which can be used at both the front and rear slots 50*a* and 50*d*. Alternatively, the insert 52 used for the rear slot 50*d* may be a mirror image of the insert 52 used for the front slot 50*a*. This insert 52 is illustrated in FIGS. 5A–5C, and has been previously described in connection with how the wheel 24*a* is mounted to the chassis 22. In addition to the above description, the bore 72 is provided not in the center of the body 60, but is instead provided at one corner of the body 60. For example, in FIG. 5A, the bore 72 is provided at the lower-left corner 80 of the body 60. The mirror image of the insert 52 in FIG. 5A would be an insert where the bore 72 is provided at the lower-right corner of the body 60.

The importance of orienting the bore 72 at one corner of the substantially oval-shaped insert 52 and the accomodating slot 50 will be apparent by reviewing FIGS. 1, 4, 8 and 9. In FIG. 1, the bore 72 of insert 52 is oriented at the upper-left corner 82 of the front slot 50*a*, and the bore 72 of the rear insert 52 is oriented at the upper-right corner 84 of the rear slot 50*d*. When the axles of the front and rear wheels 24*a*, 24*d*, respectively, are positioned in the lower openings 76 of the bores 72, the front and rear wheels 24*a* and 24*d*, respectively, are in a non-rockering position as described above. To rocker the front and rear wheels 24*a* and 24*d*, respectively, the axles of the front and rear wheels 24*a*, 24*d*, respectively, are positioned in the upper openings 74 of the bores 72, as illustrated in FIG. 4. Thus, with the bore 72 of the front insert 52 positioned at the upper-left corner 82 of front slot 50*a* and the bore 72 of the rear insert 52 positioned at the upper-right corner 84 of rear slot 50*d*, a wider wheel base is achieved. In this configuration, note that the insert 52 used for the front slot 50*a* of frame 26*a* can be used for the rear slot 50*d* of the other frame 26*b*, and vice versa. Similarly, the insert 52 used for the rear slot 50*d* of frame 26*a* can be used for the front slot 50*d* of the other frame 26*b*, and vice versa.

Figure 8:
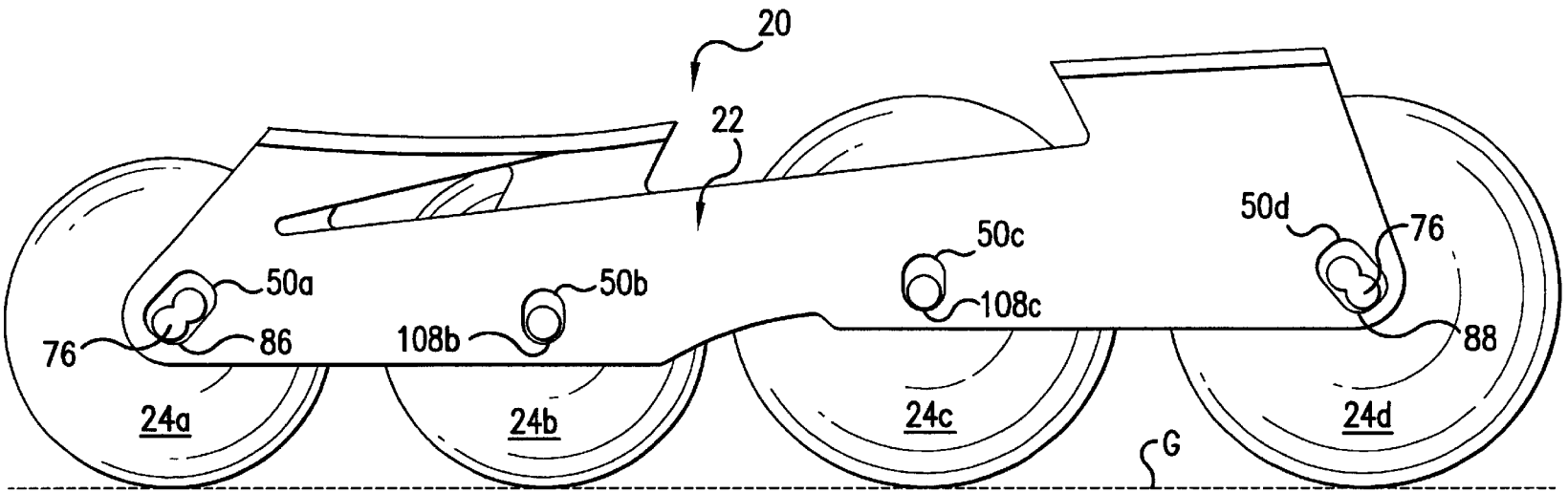
FIG. 8 is a side elevational view of the chassis and wheels of the in-line roller skate of FIG. 1 with the inserts provided in another non-rockering position.
Figure 9:
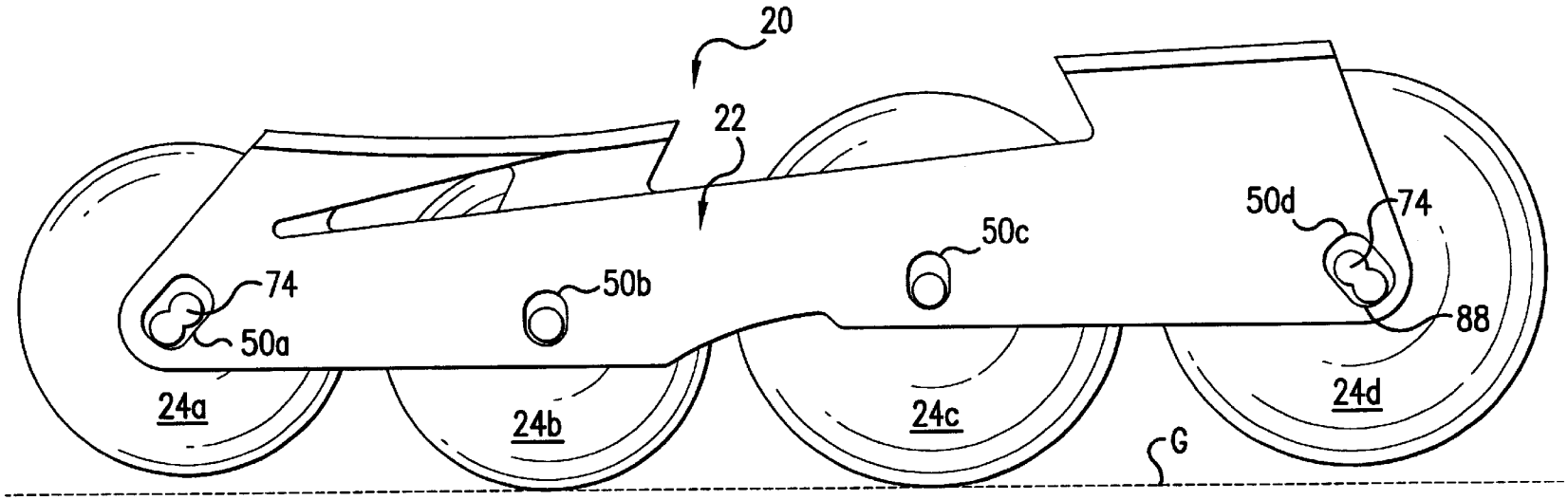
FIG. 9 is a side elevational view of the chassis and wheels of the in-line roller skate of FIG. 1 with the inserts provided in another rockering position.

Referring now to FIGS. 8 and 9, the bore 72 of insert 52 is oriented at the lower-right corner 86 of the front slot 50*a*, and the bore 72 of the rear insert 52 is oriented at the lower-left corner 88 of the rear slot 50*d*. When the axles of the front and rear wheels 24*a*, 24*d*, respectively, are positioned in the lower openings 76 of the bores 72, the front and rear wheels 24*a* and 24*d*, respectively, are in a non-rockering position since the wheels 24*a* and 24*d* would contact the ground G when in use. To rocker the front and rear wheels 24*a* and 24*d*, respectively, the axles of the front and rear wheels 24*a*, 24*d*, respectively, are positioned in the upper openings 74 of the bores 72, as illustrated in FIG. 9. Thus, with the bore 72 of the front insert 52 positioned at the lower-right corner 86 of front slot 50*a* and the bore 72 of the rear insert 52 positioned at the lower-left corner 88 of rear slot 50*d*, a narrower wheel base is achieved.

In addition, by positioning the bores 72 in a lower position within the slots 50*a* and 50*d*, the height of the chassis 22 can be adjusted with respect to the ground G. Thus, the chassis 22 in FIGS. 1 and 4 is lower or closer to the ground G than in FIGS. 8 and 9, because the bores 72 are in the upper corners of the slots 50*a* and 50*b* in FIGS. 1 and 4, while the bores 72 are in the lower corners of the slots 50*a* and 50*b* in FIGS. 8 and 9. Thus, the orientation of the insert 52 within the slots 50*a* and 50*d* can be used by the skater to adjust both the vertical height of the chassis 22 as well as the length of the wheel base. For example, to change the orientation of the insert 52 from that shown in slot 50*a* in FIG. 1 to that shown in slot 50*a* in FIG. 8, the skater merely removes the insert 52 from the slot 50*a* and rotates it by 180 degrees before re-inserting it into the slot 50*a*. Alternatively, the in-line roller skate 20 can be provided with a set of inserts 52 having their bores 72 oriented at different corners, so that the skater can pick and choose different inserts 52 for use at different slots 50*a* and 50*d*. As a further alternative, the skater can take inserts 52 from the other slots 50*a* or 50*d* of the same or the other frame 26*a* or 26*b* and use these inserts at any of the slots 50*a* or 50*d* in the manners described above.

Figure 7A:
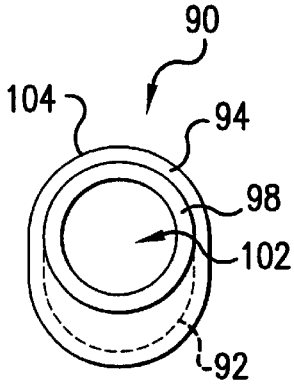
FIG. 7A is a front view of another insert positioned inside a slot of the chassis of FIG. 1.
Figure 7B:
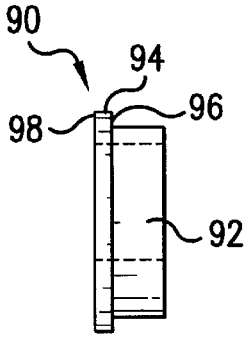
FIG. 7B is a side view of the insert of FIG. 7A.

The intermediate slots 50*b* and 50*c* are adapted to be fitted with inserts 90 that are illustrated in FIGS. 7A and 7B. The insert 90 has a substantially oval-shaped body 92 surrounded by a flange 94. FIG. 7A is a front view of the insert 90 facing the wheel 24*b* or 24*c*. The body portion 92 is configured with the same configuration as slots 50*b* and 50*c* and is adapted to be fitted therein. The inner surface 96 of the flange 94 may be rested against the inside surface 53 of the frame 26*b*, or a stepped surface (not shown) may be provided on the inside surface 53 surrounding the slot 50*b* or 50*c* for receiving the flange 94 so that the front surface 98 of the insert 90 is flush with the inside surface 53. The body 92 also defines a substantially circular bore 102 that is adapted to receive a wheel axle. The bore 102 is provided not in the center of the body 92, but is instead provided at either the upper or lower end. For example, in FIG. 7A, the bore 102 is provided in the upper end 104 of the body 92. A similar insert 90 can be positioned on the other side of wheel 24*b* for mounting to the frame 26*a*.

The offset bore 102 of the insert 90 allows the skater to adjust the height of the chassis 22 with respect to the ground G. Referring again to FIGS. 1 and 4, the bore 102 of inserts 90 are oriented at the upper ends 106*b* and 106*c* of the slots 50*b* and 50*c*, respectively. This positions the wheel axles at the highest point in the slots 50*b* and 50*c*, thereby allowing the chassis 22 to be provided as close to the ground G as possible. Conversely, referring to FIGS. 8 and 9, the bore 102 of inserts 90*b* and 90*c* are oriented at the lower ends 108*b* and 108*c* of the slots 50*b* and 50*c*, respectively. This positions the wheel axles at the lowest point in the slots 50*b* and 50*c*, thereby allowing the chassis 22 to be provided further from the ground G. As a result, the vertical position of the intermediate wheels 24*b* and 24*c* can be adjusted to suit the vertical position of the front and rear wheels 24*a* and 24*d*, respectively, that is selected by orienting the inserts 52 in the manner described above. In addition, this flexibility allows the skater to use wheels of different sizes while keeping the chassis as close to the ground as possible. For example, bigger wheels can have their axles positioned at the lower ends 108*b*, 108*c*, while smaller wheels can have their axles positioned at the lower ends 106*b*, 106*c*.

Thus, when the inserts 52 and 90 are provided in the orientations shown in FIGS. 1 and 4, the in-line roller skate 20 is provided with a wider wheel base and the chassis 22 is lower to the ground G than when the inserts 52 and 90 are provided in the orientations shown in FIGS. 8 and 9. Those skilled in the art will appreciate that many alternatives can be achieved without departing from the spirit and scope of the present invention. For example, the two inserts 90 can be oriented at different ends of the slots 50*b* and 50*c* to further accomodate differently-sized wheels. As one example, since slot 50*c* is offset at a higher vertical level than slot 50*b*, the bore 102 of insert 90 in slot 50*b* can be oriented at the upper end 106*b*, and the bore 102 of insert 90 in slot 50*c* can be oriented at the lower end 108*c*, if wheels 24*b* and 24*c* are to be of the same size. As another example, if the skater desires that the wheel 24*c* be much larger than the wheel 24*b*, the bore 102 of insert 90 in slot 50*b* can be oriented at the lower end 108*b*, and the bore 102 of insert 90 in slot 50*c* can be oriented at the upper end 106*c*. The inserts 52 for slots 50*a* and 50*d* can be similarly manipulated to achieve different alternatives.

The in-line roller skate 20 according to the present invention further provides webs 32, 34 and 36 mounted adjacent the upper edges 27 of the frames 26*a*, 26*b* at an angle with respect to the horizontal axis (i.e., the ground). Referring to FIG. 4, the webs 32, 34 and 36 are shown in dashed lines, which are angled with respect to the horizontal ground G at an angle ranging from one to 45 degrees. By providing the webs 32, 34 and 36 at an angle, the webs 32, 34 and 36 can be provided higher in the frames 26*a*, 26*b*, thereby providing more clearance for the wheels 24*a*, 24*b*, 24*c* and 24*d* which these webs 32, 34 and 36 must surround and separate. This increased clearance in turn allows the webs 32, 34 and 36 to be provided in larger sizes, thereby improving the cross-support provided by the webs 32, 34 and 36 for the frames 26*a*, 26*b*. The webs 32, 34 and 36 are also progressively larger from the front to the rear to distribute more load at the rear.

The wheels 24*a*, 24*b*, 24*c* and 24*d* are preferably spaced-apart such that the distance between the axles of the adjacent wheels is the same. However, as described above, the adjustment of the inserts 52 for rockering may increase or decrease the distances between the front wheel 24*a* and the second wheel 24*b*, and between the rear wheel 24*d* and the third wheel 24*c*. As another non-limiting example, the distance between the axles of wheels 24*a* and 24*b* may be different from the spacing between wheels 24*c* and 24*d* to allow wheel 24*b* to be positioned more forward to be directly under the ball of the foot for more responsive maneuverability.

Figure 10:
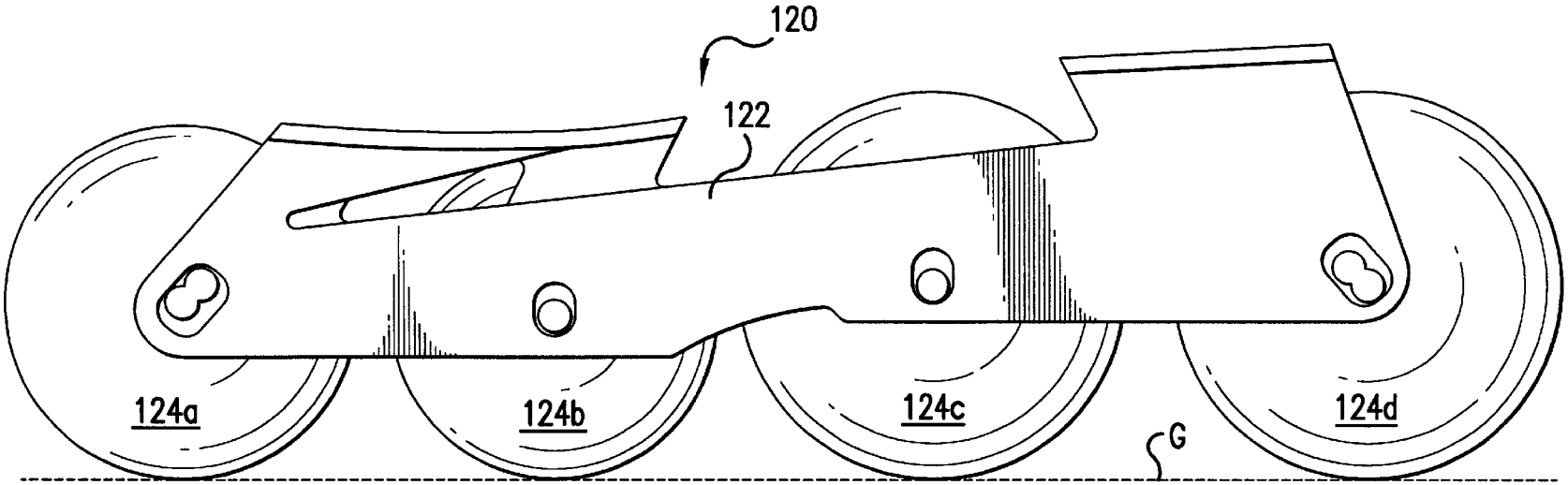
FIG. 10 is a side elevational view of the chassis and wheels of an in-line roller skate according to a second embodiment of the present invention.

A second preferred embodiment of the present invention is illustrated in FIG. 10. The in-line roller skate 120 is essentially the same as in-line roller skate 20, except that the second wheel 124*b* is smaller than the front wheel 124*a*. The front wheel 124*a* is still smaller than the two rear wheels 124*c* and 124*d*, which are preferably of the same size. As a non-limiting example, the front wheel 124*a* has a diameter of 74 mm, the second wheel 124*b* has a diameter of 70 mm, and the two rear wheels 124*c* and 124*d* have a diameter of 82 mm. Providing the second wheel 124*b* with the smallest size has the benefit of allowing the chassis 122 to be provided very close to the ground G. Given the normal arch of a person's foot, the second wheel 124*b* would normally be positioned below the lowest point in the arch of the foot. In addition, the second wheel 124*b* is normally the most commonly used wheel for maneuvering, and is provided at a smaller size to improve maneuverability. The normal arch of a person's foot also means that the front wheel 124*a* could be larger because there is more clearance or room under the toes of the foot. As a result, by providing the front wheel 124*a* slightly larger than the second wheel 124*b*, the speed of the in-line roller skate 120 can be improved without compromising maneuverability.

Figure 11:
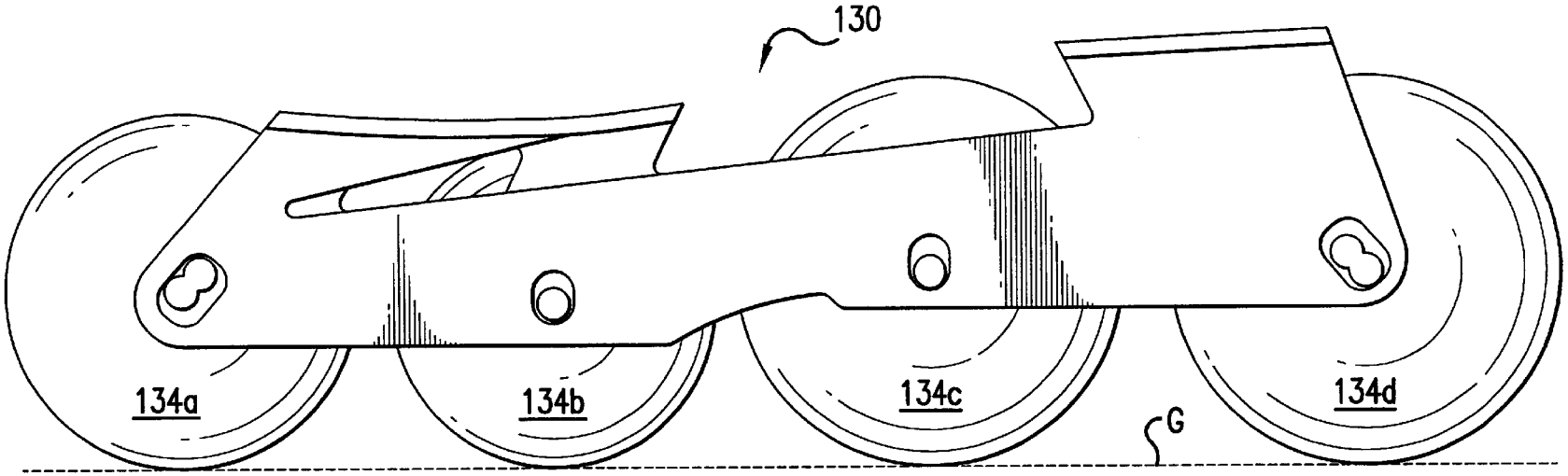
FIG. 11 is a side elevational view of the chassis and wheels of an in-line roller skate according to a third embodiment of the present invention.

A third preferred embodiment of the present invention is illustrated in FIG. 11. The in-line roller skate 130 is essentially the same as in-line roller skate 120, except that the third wheel 134*c* is now smaller than the rear wheel 134*d* but still larger than the front wheel 134*a*. As a non-limiting example, the front wheel 134*a* has a diameter of 70 mm, the second wheel 134*b* has a diameter of 66 mm, the third wheel 134*c* has a diameter of 78 mm, and the rear wheel 134*d* has a diameter of 84 mm. This embodiment provides a more gradual increase in sizing between the wheels 134*a*–134*d* for better stability.

Figure 12:
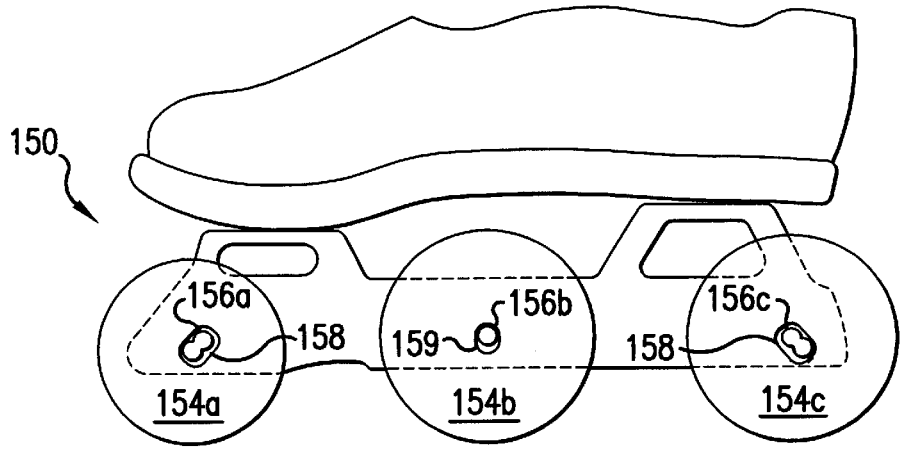
FIG. 12 is a side elevational view of the chassis and wheels of an in-line roller skate according to a fourth embodiment of the present invention.

A fourth preferred embodiment of the present invention is illustrated in FIG. 12. The in-line roller skate 150 has a chassis 152 which supports three wheels 154*a*, 154*b* and 154*c* in the manner described above for in-line roller skate 20. The front and rear wheels 154*a* and 154*c* are supported at angled slots 156*a* and 156*c*, respectively, by inserts 158 that are the same as insert 52 described above. These inserts 158 have a Figure-8 bore provided at one corner of the insert and which allow for adjustment of the height of the chassis 152 and the length of the wheel base in the manner described above. The intermediate wheel 154*b* is supported at slot 156*b* by insert 159 which is the same as insert 90 described above. Insert 159 has a substantially circular bore provided at one end of the insert and which allows for adjustment of the vertical position of the wheel 154*b* in the manner described above. The centers of intermediate and rear slots 156*b* and 156*c* are positioned along a horizontal line parallel to the ground G that is offset from and vertically higher than the center line of front slot 156*a*.

The front wheel 154*a* is preferably smaller than the intermediate wheel 154*b* and the rear wheel 154*c*. The intermediate wheel 154*b* and the rear wheel 154*c* preferably have the same diameter. As a non-limiting example, the front wheel 154*a* has a diameter of 76 mm, and the intermediate and rear wheels 154*b* and 154*c* have a diameter of 80 mm. The spacing between each of the three wheels 154*a*, 154*b* and 154*c* may be the same or can be varied, for the reasons described above in connection with wheels 24*a*–24*d*.

As an alternative, all three wheels 154*a*, 154*b* and 154*c* may be provided in different sizes, with the rear wheel 154*c* being the largest.

Three-wheeled chassis such as chassis 152 are normally provided for smaller shoe sizes (e.g., size 4 and under) because the smaller shoes do not provide sufficient spacing needed for four wheels. However, the offset slots (i.e., offset axles) described above in connection with chassis 22 for slots 50*a*–50*d* together with the different wheel sizes may allow the four-wheel chassis 22 to be provided for smaller size shoes.

Figure 13:
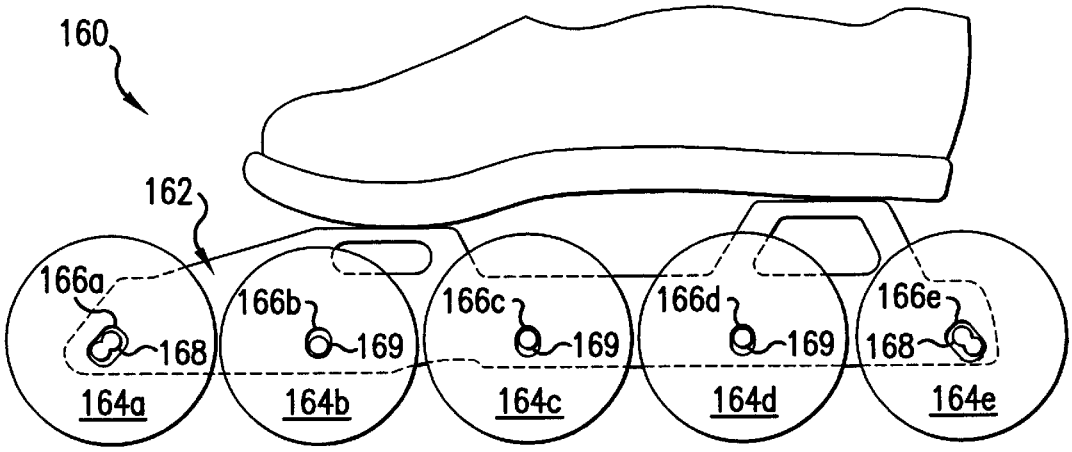
FIG. 13 is a side elevational view of the chassis and wheels of an in-line roller skate according to a fifth embodiment of the present invention.

A fifth preferred embodiment of the present invention is illustrated in FIG. 13. The in-line roller skate 160 has a chassis 162 which supports five wheels 164*a*, 164*b*, 164*c*, 164*d* and 164*e* in the manner described above for in-line roller skate 20. The front and rear wheels 164*a* and 164*e* are supported at angled slots 166*a* and 166*e*, respectively, by inserts 168 that are the same as insert 52 described above. These inserts 168 have a Figure-8 bore provided at one corner of the insert and which allows for adjustment of the height of the chassis 162 and the length of the wheel base in the manner described above. The three intermediate wheels 164*b*, 164*c* and 164*d* are supported at slots 166*b*, 166*c* and

166*d*, respectively, by inserts 169 which are the same as insert 90 described above. Insert 169 has a substantially circular bore provided at one end of the insert and which allow for adjustment of the vertical position of the wheels 164*b*, 164*c* and 164*d* in the manner described above. The centers of the third slot 166*c*, the fourth slot 166*d*, and the rear slot 166*e* are positioned along a horizontal line parallel to the ground G that is offset from and vertically higher than the horizontal line that connects the centers of the front slot 166*a* and the second slot 166*b*.

The front wheel 164*a* and the second wheel 164*b* have the same diameter and are preferably smaller than the third wheel 164*c*, the fourth wheel 164*d* and the rear wheel 164*e*. The third wheel 164*c*, the fourth wheel 164*d* and the rear wheel 164*e* preferably have the same diameter. As a non-limiting example, the front wheel 164*a* and the second wheel 164*b* have a diameter of 76 mm, and the third wheel 164*c*, the fourth wheel 164*d* and the rear wheel 164*e* each have a diameter of 80 mm. The spacing between each of the five wheels 164*a*, 164*b*, 164*c*, 164*d* and 164*e* may be the same or can be varied, for the reasons described above in connection with wheels 24*a*–24*d*.

Alternatively, the centers of the fourth slot 166*d* and the rear slot 166*e* are positioned along a horizontal line parallel to the ground G that is offset from and vertically higher than the horizontal line that connects the centers of the front slot 166*a*, the second slot 166*b*, and third slot 166*c*. In this configuration, the front wheel 164*a*, the second wheel 164*b* and the third wheel 164*c* have the same diameter and are preferably smaller than the fourth wheel 164*d* and the rear wheel 164*e*. The fourth wheel 164*d* and the rear wheel 164*e* preferably have the same diameter.

As yet a further alternative, all five wheels 164*a*, 164*b*, 164*c*, 164*d* and 164*e* may be provided in different sizes, with the rear wheel 164*e* being the largest.

Although the above embodiments of the in-line roller skates of the present invention illustrate the centers of two or more slots positioned along an imaginary horizontal line parallel to the ground that is vertically offset or is at a different vertical level from another imaginary horizontal line which connects the centers of two or more other slots, it will be appreciated by those skilled in the art that many alternatives can be provided. As a non-limiting example, the centers of all the slots on the frames can be provided at different vertical levels, with the front-most slot having the lowest vertical level and the rear-most slot having the highest vertical level to provide a gradual increase in sizing between the wheels for better stability. As another non-limiting example, individual slots or different combinations of adjacent slots can be provided along imaginary horizontal lines that are at different vertical levels from other individual slots or other combinations of adjacent slots.

Thus, the in-line roller skates according to the present invention provide both improved maneuverability and the potential for achieving greater speeds by providing smaller front wheels to enhance maneuverability and larger rear wheels to improve the speed. The present invention further provides two sets of inserts that allow the skater to simultaneously adjust the wheel base of the roller skate, and the height of the chassis with respect to the ground. As a result, the skater is able to adjust the roller skates to suit his or her skating style, experience and intended use.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A roller skate, comprising:

a chassis comprising a first frame and a second frame extending longitudinally parallel to each other, each frame having a front end and a rear end;

a first wheel, a second wheel, a third wheel and a fourth wheel rotatably mounted in spaced apart manner between the first and second frames;

a first slot, a second slot, a third slot and a fourth slot provided in spaced apart manner in each frame, the first slot positioned adjacent the front end of the frames and the fourth slot positioned adjacent the rear end of the frames;

wherein the first, second, third and fourth wheels are mounted adjacent the first, second, third and fourth slots, respectively, of both frames; and a first insert fitted inside the first and fourth slots, the first insert comprising a first corner and at least one other corner, the insert further comprising a bore having a Figure-8 configuration defining two substantially circular openings, the bore positioned adjacent the first corner and closer to the first corner than other corners.

2. The roller skate of claim 1, further comprising a second insert fitted inside the second and third slots, the second insert comprising an upper end, a lower end and a bore, the bore having a substantially circular configuration, the bore positioned closer to either the upper or the lower end than to the other end.

3. The roller skate of claim 1, further comprising a spacer collar positioned between the first insert and the first or fourth wheel, the spacer collar comprising a substantially circular bore for alignment with one of the substantially circular openings of the first insert, and a substantially circular protrusion fitted inside the other substantially circular opening of the first insert.

4. The roller skate of claim 1, wherein the first and fourth slots are angled with respect to the horizontal and vertical axes.

5. The roller skate of claim 1, further comprising a plurality of webs mounted between the first and second frames for providing cross-support to the chassis, and wherein the first and second frames each comprises an upper edge, wherein the webs are mounted adjacent the upper edges of the first and second frames at an angle with respect to the horizontal axis to provide increased clearance for the wheels.

6. A method of adjusting the wheel base and the height of the chassis of an in-line roller skate, comprising the steps of:

a. providing an in-line roller skate comprising:

(i) a chassis comprising a first frame and a second frame extending longitudinally parallel to each other, each frame having a front end and a rear end;

(ii) a first wheel, a second wheel, a third wheel and a fourth wheel rotatably mounted in spaced apart manner between the first and second frames;

(iii) a first slot, a second slot, a third slot and a fourth slot provided in spaced apart manner in each frame, the first slot positioned adjacent the front end of the frames and the fourth slot positioned adjacent the rear end of the frames, the first and fourth slots each comprising first and second corners opposite to each other;

(iv) wherein the first, second, third and fourth wheels are mounted adjacent the first, second, third and fourth slots, respectively, of both frames; and (v) a first insert fitted inside the first slot and a fourth insert fitted inside the fourth slot,'the first and fourth inserts each comprising a first corner and a second corner opposite the first corner, the first and fourth insert each further comprising a bore having a Figure-8 configuration defining two substantially circular openings, the bore positioned adjacent the first corner and closer to the first corner than the second corner;

b. positioning the first insert in the first slot such that the bore of the first insert is closer to the first corner of the first slot than the second corner of the first slot, and positioning the fourth insert in the fourth slot such that the bore of the fourth insert is closer to the second corner of the fourth slot than the first corner of the -fourth slot; and c. rotating the first insert in the first slot by 180 degrees so that the bore of the first insert is closer to the second corner of the first slot than the first corner of the first slot, and rotating the fourth insert in the fourth slot by 180 degrees so that the bore of the fourth insert is closer to the first corner of the fourth slot than the second corner of the fourth slot.

7. The method of claim 6, wherein the chassis further comprises second and third inserts fitted inside the second and third slots, respectively, the second and third inserts each comprising an upper end, a lower end and a bore, the bore having a substantially circular configuration, the bore positioned closer to either the upper or the lower end than to the other end, the second and third slots each comprising an upper end and a lower end, the method further comprising the steps of:

d. positioning the second insert in the second slot such that the bore of the second insert is closer to either the upper or lower end of the second slot than the other end of the second slot, and positioning the third insert in the third slot: such that the bore of the third insert is closer to either the upper or lower end of the third slot than the lower end of the third slot; and e. rotating the second insert in the second slot by 180 degrees so that the bore of the second insert is closer to the other end of the second slot, and rotating the third insert in the third slot by 180 degrees so that the bore of the third insert is closer to the other end of the third slot.

8. A roller skate, comprising:

chassis comprising a first frame and a second frame extending longitudinally parallel to each other, each frame having a front end and a rear end; and exactly four wheels, including a first wheel, a second wheel, a third wheel and a fourth wheel rotatably mounted in spaced apart manner between the first and second frames, with the first wheel positioned adjacent the front end of the frames and the fourth wheel positioned adjacent the rear end of the frames;

wherein the first and second wheels have the same size, the third and fourth wheels have the same size, and the third and fourth wheels are larger than the first and second wheels, and all four wheels are arranged so that all four wheels simultaneously contact a tractive surface when the roller skate is in use.

9. The roller skate of claim 8, wherein each frame has a length that defines a horizontal axis, and wherein the roller skate further includes a plurality of webs mounted between the first and second frames for providing cross-support to the chassis, and wherein the first and second frames each has an upper edge, with the webs are mounted adjacent the upper edges of the first and second frames at an angle with respect to the horizontal axis to provide increased clearance for the wheels.

10. The roller skate of claim 9, wherein the webs are progressively larger from the front to the rear of the frames.

11. A roller skate, comprising:

a chassis comprising a first frame and a second frame extending longitudinally parallel to each other, each frame having a front end and a rear end; and exactly four wheels, including a first wheel, a second wheel, a third wheel and a fourth wheel rotatably mounted in spaced apart manner between the first and second frames, with the first wheel positioned adjacent the front end of the frames and the fourth wheel positioned adjacent the rear end of the frames;

wherein the third and fourth wheels have the same size, the second wheel is smaller than the first wheel, and the third and fourth wheels are larger than the first and second wheels, and all four wheels are arranged so that all four wheels simultaneously contact a tractive surface when the roller skate is in use.

12. The roller skate of claim 11, wherein each frame has a length that defines a horizontal axis, and wherein the roller skate further includes a plurality of webs mounted between the first and second frames for providing cross-support to the chassis, and wherein the first and second frames each has an upper edge, with the webs are mounted adjacent the upper edges of the first and second frames at an angle with respect to the horizontal axis to provide increased clearance for the wheels.

13. The roller skate of claim 12, wherein the webs are progressively larger from the front to the rear of the frames.

14. A roller skate, comprising:

a chassis comprising a first frame and a second frame extending longitudinally parallel to each other, each frame having a front end and a rear end; and exactly four wheels, including a first wheel, a second wheel, a third wheel and a fourth wheel rotatably mounted in spaced apart manner between the first and second frames, with the first wheel positioned adjacent the front end of the frames and the fourth wheel positioned adjacent the rear end of the frames;

wherein the third wheel is smaller than the fourth wheel, the second wheel is smaller than the first wheel, and the third wheel is larger than the first and second wheels, and all four wheels are arranged so that all four wheels simultaneously contact a tractive surface when the roller skate is in use.

15. The roller skate of claim 14, wherein each frame has a length that defines a horizontal axis, and wherein the roller skate further includes a plurality of webs mounted between the first and second frames for providing cross-support to the chassis, and wherein the first and second frames each has an upper edge, with the webs are mounted adjacent the upper edges of the first and second frames at an angle with respect to the horizontal axis to provide increased clearance for the wheels.

16. The roller skate of claim 15, wherein the webs are progressively larger from the front to the rear of the frames.

* * * * *